US006434801B2

(12) United States Patent
Grunberger

(10) Patent No.: US 6,434,801 B2
(45) Date of Patent: Aug. 20, 2002

(54) MAGNETIC CLOSURE FOR ITEMS OF CLOTHING

(75) Inventor: Erico Grunberger, Milan (IT)

(73) Assignee: SAMA S.p.A., Ronco Briantino (IT)

( * ) Notice: Subject to any disclaimer, the term of this patent is extended or adjusted under 35 U.S.C. 154(b) by 0 days.

(21) Appl. No.: 09/826,921

(22) Filed: Apr. 6, 2001

Related U.S. Application Data

(63) Continuation-in-part of application No. 09/200,774, filed on Nov. 30, 1998, now abandoned.

(30) Foreign Application Priority Data

Dec. 12, 1997 (IT) ..... MI97A2763

(51) Int. Cl.[7] ..... A44B 1/00; A41F 1/00
(52) U.S. Cl. ..... 24/303; 24/66.1; 24/114.6
(58) Field of Search ..... 124/303, 66.1, 124/114.6; 292/251.5

(56) References Cited

U.S. PATENT DOCUMENTS

| | | | | | |
|---|---|---|---|---|---|
| 2,319,292 | A | * | 5/1943 | Boggs | 24/303 |
| 2,363,914 | A | * | 11/1944 | Wakefield | 24/303 |
| 2,389,299 | A | * | 11/1945 | Ellis | 24/303 |
| 3,161,932 | A | * | 12/1964 | Russell | 24/303 |
| 3,254,440 | A | * | 6/1966 | Duggar | 24/303 |
| 3,529,328 | A | * | 9/1970 | Davison | 24/303 |
| 4,399,595 | A | * | 8/1983 | Yoon et al. | 24/303 |
| 5,450,658 | A | * | 9/1995 | Hicks | 24/303 |
| 5,604,960 | A | * | 2/1997 | Elaine | 24/303 |
| 5,682,653 | A | * | 11/1997 | Berglof et al. | 24/303 |

FOREIGN PATENT DOCUMENTS

| | | | |
|---|---|---|---|
| DE | 8405339 | * | 5/1985 |
| EP | 0818155 | * | 1/1998 |

* cited by examiner

*Primary Examiner*—Victor Sakran
(74) *Attorney, Agent, or Firm*—Guido Modiano; Albert Josif; Daniel O'Byrne

(57) ABSTRACT

A magnetic closure particularly for items of clothing and the like, comprising a magnetic body which is accommodated in a seat which is closed hermetically and is formed by two plate-like elements which are mutually coupled at least in a region which peripherally surrounds the magnetic body. The coupled plate-like elements (10,11) can be applied to each one of a couple of flaps to be joined.

6 Claims, 2 Drawing Sheets

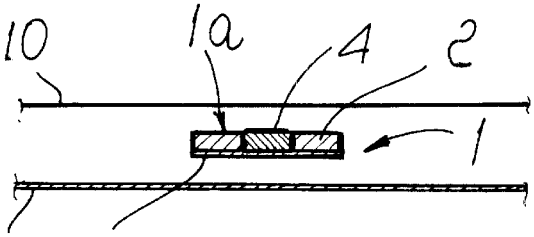
Fig. 4
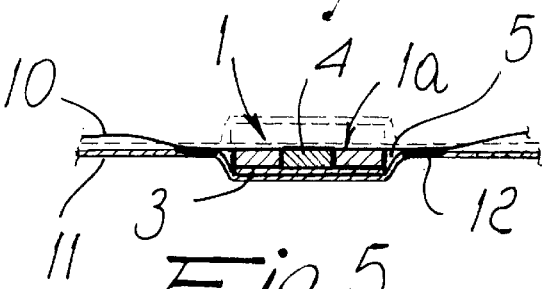
Fig. 5
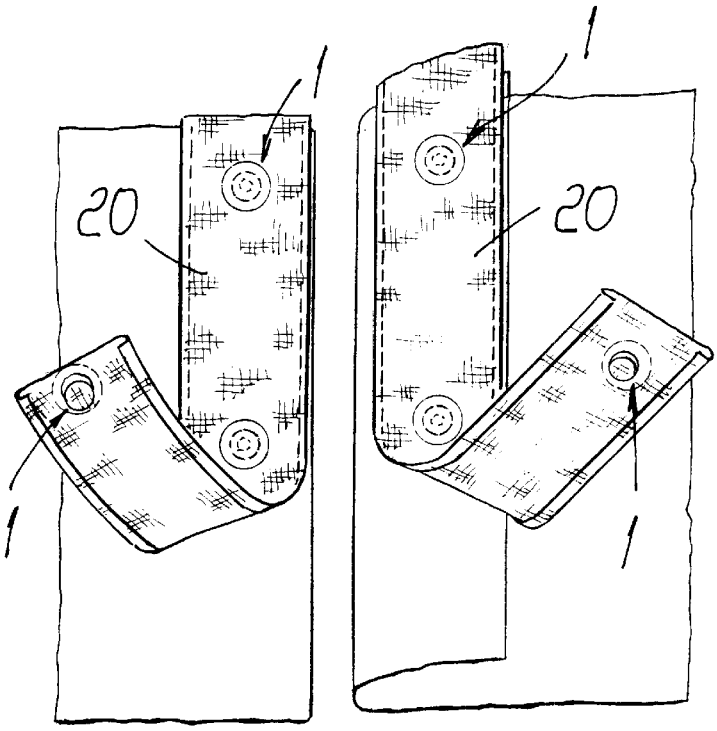
Fig. 6
Fig. 7
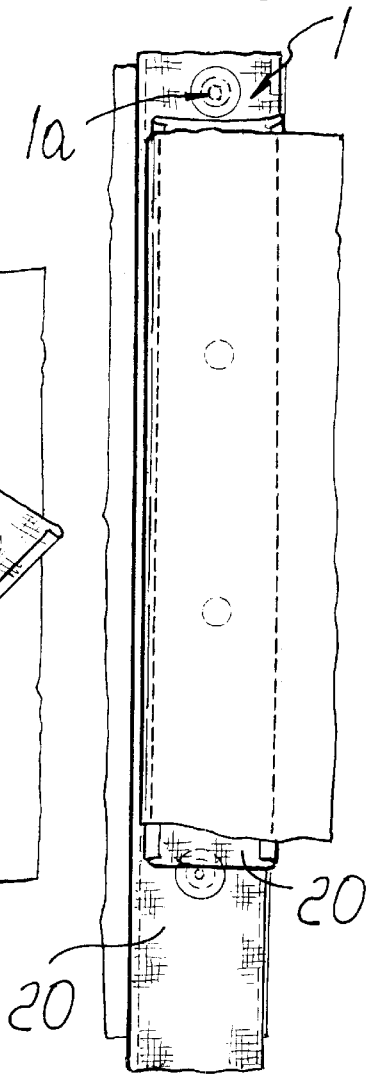

MAGNETIC CLOSURE FOR ITEMS OF CLOTHING

This is a Continuation-in-part Application of U.S. Ser. No. 09/200,774 filed on Nov. 30, 1998, now abandoned.

BACKGROUND OF THE INVENTION

The present invention relates to a magnetic closure particularly for items of clothing and the like.

It is known that so-called magnetic closures have long been commercially available. Such closures are generally provided by means of an annular permanent magnet which is associated with a disk provided with a pin made of ferromagnetic material which is substantially meant to concentrate the lines of magnetic flux, thus improving the effectiveness of the magnetic closure.

These magnetic elements cannot be used in clothing because they include ferrous elements which can be subject to rust arising from infiltrations of water and moisture, which are inevitable in wet or dry cleaning.

SUMMARY OF THE INVENTION

The aim of the present invention is to solve the above problem, by providing a magnetic closure particularly for items of clothing and the like in which it is possible to isolate the magnetic body hermetically, thus absolutely preventing infiltrations of water and moisture.

Within the scope of this aim, a particular object of the present invention is to provide a magnetic closure which can be easily connected to an item of clothing and the like both by heat-sealing and the like and by sewing.

Another object of the present invention is to provide a magnetic closure in which it is possible to adjust at will the force of the magnetic attraction between the parts to be joined.

Another object of the present invention is to provide a magnetic closure which by virtue of its particular constructive characteristics is capable of giving the greatest assurances of reliability and safety in use and is also competitive from a purely economical point of view.

This aim, these objects and others which will become apparent hereinafter are achieved by a magnetic closure particularly for items of clothing and the like, according to the invention, characterized in that it comprises a magnetic body accommodated in a seat which is closed hermetically and is formed by two plate-like elements which are mutually coupled at least in a region which peripherally surrounds said magnetic body, said coupled plate-like elements being applicable to each one of a couple of flaps to be joined.

BRIEF DESCRIPTION OF THE DRAWINGS

Further characteristics and advantages of the present invention will become apparent from the following detailed description of a preferred but not exclusive embodiment of a magnetic closure particularly for items of clothing and the like, illustrated only by way of non-limitative example in the accompanying drawings, wherein:

FIG. 4 is a sectional exploded view of the magnetic closure according to the invention;

FIG. 5 is a sectional view of the magnetic closure;

FIG. 6 is a schematic view, in the open position, of a magnetic closure to be applied to flaps of an item of clothing and the like;

FIG. 7 is a schematic view of the magnetic closure in the closure position.

DESCRIPTION OF THE PREFERRED EMBODIMENTS

Figure 1:
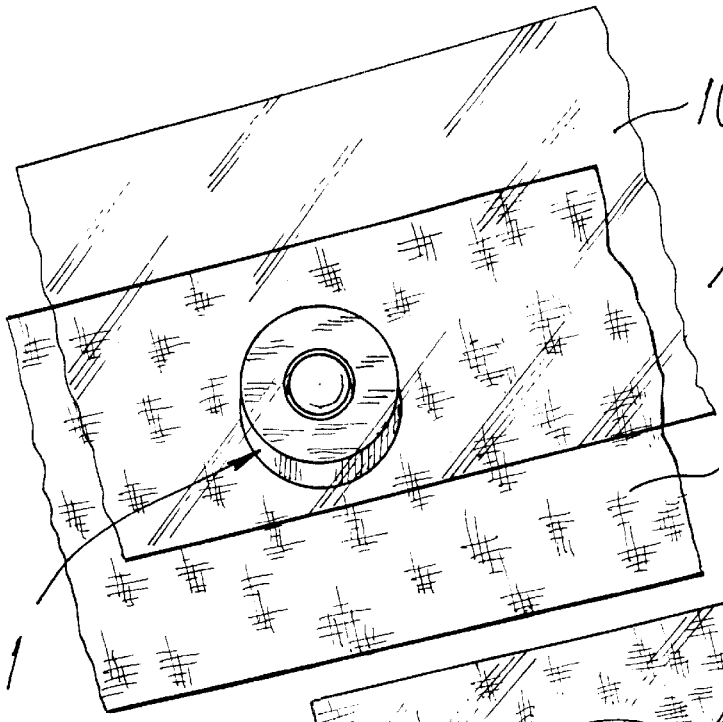
FIG. 1 is a schematic exploded perspective view of the elements that compose the magnetic closure according to the present invention.
Figure 2:
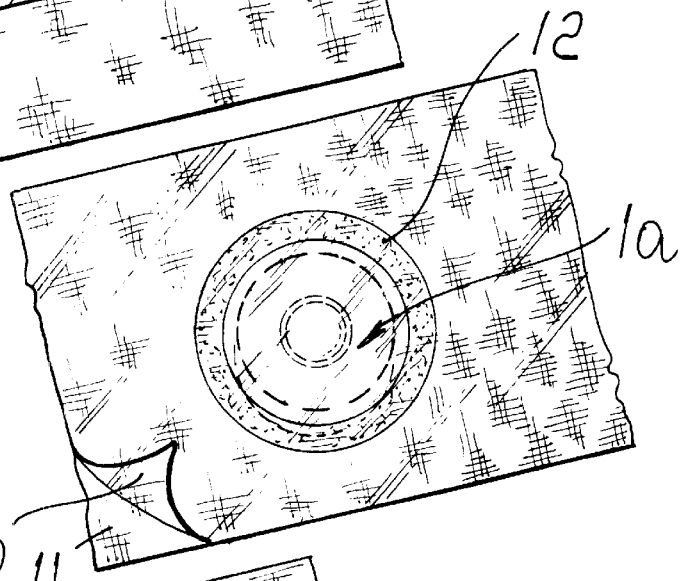
FIG. 2 is a view of one side of the assembled magnetic closure.
Figure 3:
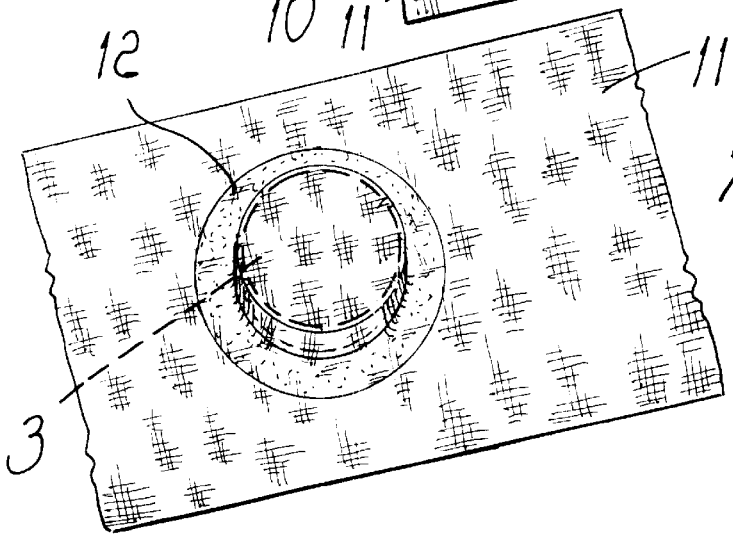
FIG. 3 is a view of the assembled magnetic closure, taken from the other side.

With reference to the above figures, the magnetic closure particularly for items of clothing and the like, according to the invention, comprises a magnetic body, generally designated by the reference numeral 1, which is constituted by a permanent magnet 2 advantageously associated with a metal plate 3 from which a pin 4 protrudes which is meant to concentrate the magnetic flux.

The particularity of the invention is constituted by the fact that the magnetic body 1 is accommodated in a seat 5 which is closed hermetically with respect to the outside and is formed in practice by two plate-like elements 10 and 11 provided by means of calendered plastic materials which form a thin layer.

The plate-like elements 10 and 11 are mutually coupled at least in a region 12 that surrounds the magnetic body 1 so as to form the seat 5, which is perfectly hermetically closed.

This coupling, which is for example provided with an annular configuration 12, is achieved by heat-sealing, ultrasound welding, gluing or the like, thus achieving the stable coupling of the two plate-like elements.

Advantageously, the face la of the magnetic body 1, which is the face that can be coupled to another similar magnetic body or to a ferromagnetic body provided in the other flap to be joined, is substantially flat, so as to avoid producing edges which protrude in the region of mutual coupling; accordingly, the seat 5 is formed in practice, in its lateral portions, by the plate-like element 11 with reference to the specific example.

Advantageously, the plate-like elements 10 and 11 are made of PVC or other calendered plastic materials and this solution is ideally suited for applying the magnetic closure to items of clothing or in any case to elements which allow application by heat-sealing or ultrasound welding.

If the closure must be applied by sewing, the use of plate-like elements made of calendered plastic materials is not advisable since sewing can trigger breakage.

In order to facilitate the application of the magnetic closure by sewing, one of the plate-like elements, preferably the plate-like element 10 that does not constitute the region for coupling to the other magnetic closure, is provided by means of a fabric coated with PVC or polyurethane or other plastic material which is meant to waterproof it.

The use of two plate-like elements 10 and 11 made of fabrics coated with plastic material is not advisable because their coupling generates wrinkles which reduce friction and accordingly reduce the adhesion force, which is instead optimum if the coupling surfaces are perfectly smooth, as indeed occurs with smooth calendered plastic parts, whose thickness allows to adjust the attraction force at will.

In particular, the thickness of the two plate like elements should be reduced, at a region corresponding to the seat of the magnetic body, with respect to the regions adjacent to the seat.

This reduction of the thickness of the plate like element allows to adjust the attraction force, i.e. to enhance it by increasing the magnetic flux of the magnetic body.

The magnetic closure as described can be advantageously provided by using strips of material, designated by the reference numeral 20 in FIGS. 6 and 7, in which the various magnets are already inserted at preset distances and which can be easily connected to an item of clothing, as shown schematically in FIGS. 6 and 7.

From the above description it is thus evident that the invention achieves the intended aim and objects, and in particular the fact is stressed that a magnetic closure is provided which allows to confine the permanent magnet within a hermetically closed region which gives optimum assurances of mechanical strength also by virtue of the refinement of leaving the coupling faces substantially flat, in practice forming the hermetically closed seat by using the material of the other coupled plate-like element.

Moreover, the provision of the magnetic body by means of a magnet that is permanently associated to plate-like elements made of ferromagnetic material which concentrates the magnetic-flux lines, allows to achieve a magnetic closure in which the flux lines are directed substantially toward the outside and do not have significant emissions at the rear of the item that could be in constant contact with the user's body.

The invention thus conceived is susceptible of numerous modifications and variations, all of which are within the scope of the inventive concept.

All the details may also be replaced with other technically equivalent elements.

In practice, the materials employed, as well as the dimensions and the contingent shapes, may be any according to requirements.

The disclosures in Italian Patent Application No. MI97A002763 from which this application claims priority are incorporated herein by reference.

What is claimed is:

1. A magnetic closure for items of clothing and the like, comprising a magnetic body which can be accommodated in a seat which is closed hermetically and is formed by two plate-like elements mutually coupled at least in a region which peripherally surrounds said magnetic body and is strictly adjacent to said magnetic body, said coupled plate-like elements being applicable to at least one of a couple of flaps to be joined, said plate like elements being constituted by sheets of calendered plastics which form a thin layer, one of said plate like elements, which is to be arranged facing an opposite flap, having, at a region corresponding to the seat of said magnetic body, a lower thickness with respect to regions thereof adjacent to said magnetic body, to increase the magnetic flux of said magnetic body.

2. The magnetic closure according to claim 1, wherein said plate-like elements are applicable to each one of the flaps to be joined.

3. The magnetic closure according to claim 1, wherein said region that peripherally surrounds said magnetic body has an annular shape.

4. The magnetic closure according to claim 1, wherein one of said plate-like elements is constituted by a fabric coated with a layer of plastic material.

5. The magnetic closure according to claim 1, wherein the plate-like element of one part of the magnetic closure that can be coupled to the other plate-like element of the other part of the magnetic closure is substantially flat at a region affected by the magnetic body, said seat being delimited laterally by the other coupled plate-like element.

6. The magnetic closure according to claim 1, wherein said plate-like elements are provided by strips preset for application to an item of clothing with the magnetic bodies inserted at preset distances.

* * * * *